US008132274B1

(12) United States Patent
Peterman

(10) Patent No.: US 8,132,274 B1
(45) Date of Patent: Mar. 13, 2012

(54) ADJUSTABLE POOL COVER SUPPORT

(76) Inventor: Percy Peterman, Keyport, NJ (US)

( * ) Notice: Subject to any disclaimer, the term of this patent is extended or adjusted under 35 U.S.C. 154(b) by 326 days.

(21) Appl. No.: 12/589,823

(22) Filed: Oct. 30, 2009

(51) Int. Cl.
*E04H 4/08* (2006.01)

(52) U.S. Cl. ..... 4/498

(58) Field of Classification Search ..... 4/498; 52/3, 52/5; 135/115, 124, 135–136
See application file for complete search history.

(56) References Cited

U.S. PATENT DOCUMENTS 3,063,062 A 11/1962 Logan
3,813,704 A 6/1974 Troiano
4,000,527 A 1/1977 Gannon
4,685,254 A 8/1987 Terreri
4,953,239 A 9/1990 Gadsby
5,067,182 A 11/1991 Koelsch
5,901,503 A 5/1999 Dalene
6,381,767 B1 * 5/2002 Brashears ..... 4/498
6,442,773 B1 * 9/2002 Kopyar et al. ..... 4/498
6,807,688 B1 * 10/2004 Popowski et al. ..... 4/498
2006/0101569 A1 * 5/2006 Tripp ..... 4/498

* cited by examiner

*Primary Examiner* — Charles Phillips
(74) *Attorney, Agent, or Firm* — Richard L. Mikesell

(57) ABSTRACT

A pool cover supporting unit includes a plurality of spokes connected to a central hub. The hub rests floats in the pool and the spokes can be lengthened as needed to accommodate pools of various shapes, such as an oval pool. The unit is easily collapsed for storage and easily assembled for use.

12 Claims, 3 Drawing Sheets

ADJUSTABLE POOL COVER SUPPORT

TECHNICAL FIELD OF THE INVENTION

The present invention relates to the general art of swimming pools, and to the particular field of swimming pool cover supports.

BACKGROUND OF THE INVENTION

The usual winterizing procedure for a swimming pool involves cleaning the pool, applying chemicals to keep the water free from algae and bacteria, the chemicals also including an anti-freezing agent to keep the water from freezing with the concomitant expansion of the ice which could burst the pool. Swimming pool covers are commonly used when a pool is not being used to prevent contamination by debris and the like, to reduce water evaporation and loss of purifying chemicals, and to guard against unauthorized use or at least to advise the observer that the pool is closed to use. During the fall and winter seasons, most outdoor swimming pools are not in use and falling leaves and debris driven by winter storms often find their way into such pools. Owners or those who are charged with maintaining outdoor pools are, therefore, forced to cover their pools or face expensive cleaning operations each Spring.

A wide variety of pool covers is available for keeping debris out of outdoor swimming pools while they are not in use during the fall and winter seasons. However, many of the existing pool covers allow many gallons of rainwater, snow, ice, and unwanted debris to build-up on the cover. This not only causes the cover to sag under the weight accumulation of the water and debris but also increases the possibility of contaminating the pool water with algae, dust, and dirt that are often mixed with the collected water.

For example, many present pool covers are typically large tarpaulins shaped to overlap the perimeter of a pool. The tarpaulins are held tautly in place by stakes or eye bolts fixed in concrete. A disadvantage attending the use of tarpaulins for covering pools lies in the fact that the same debris which would contaminate the underlying pool if left uncovered accumulates on the tarpaulin surface instead. Any other material falling on the tarpaulin's surface, including rain and snow, likewise accumulate on the tarpaulin surface increasing the likelihood that the tarpaulin will be over stressed and torn. The accumulation frequently causes the cover to sag in the center, causing a collection of water and debris to form a pool in the center of the cover.

If the tarpaulin pool covers does not sag, but remains taut, it has a significantly unfortunate capacity for camouflaging the danger posed to small children by swimming pools. The flat surface presented by a tarpaulin pool cover often appears to a child to be a surface upon which they may walk. Inability of the tarpaulin and/or its tethering posts to support the weight of a child can have obviously tragic results.

Still further, many pools have special shapes which makes it nearly impossible to provide a single, off-the-shelf pool cover thereby necessitating a custom pool cover which can be very expensive.

It would, therefore, be advantageous for outdoor pool owners, maintainers, and small children living in the vicinity of a swimming pool to provide an apparatus which elevates the pool cover at the center, thereby, decreasing the sagging which causes the accumulation of debris, water, and snow on its surface. The elevation causes the cover to distinguish itself from surrounding ground surface by rising above ground level. The apparatus also should be easily adapted to pools of various shapes.

SUMMARY OF THE INVENTION

These, and other, objects are achieved by a pool cover supporting unit that includes a plurality of spokes connected to a central hub. The hub floats in the pool and the spokes can be lengthened as needed to accommodate pools of various shapes, such as an oval pool. The unit is easily collapsed for storage and easily assembled for use.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
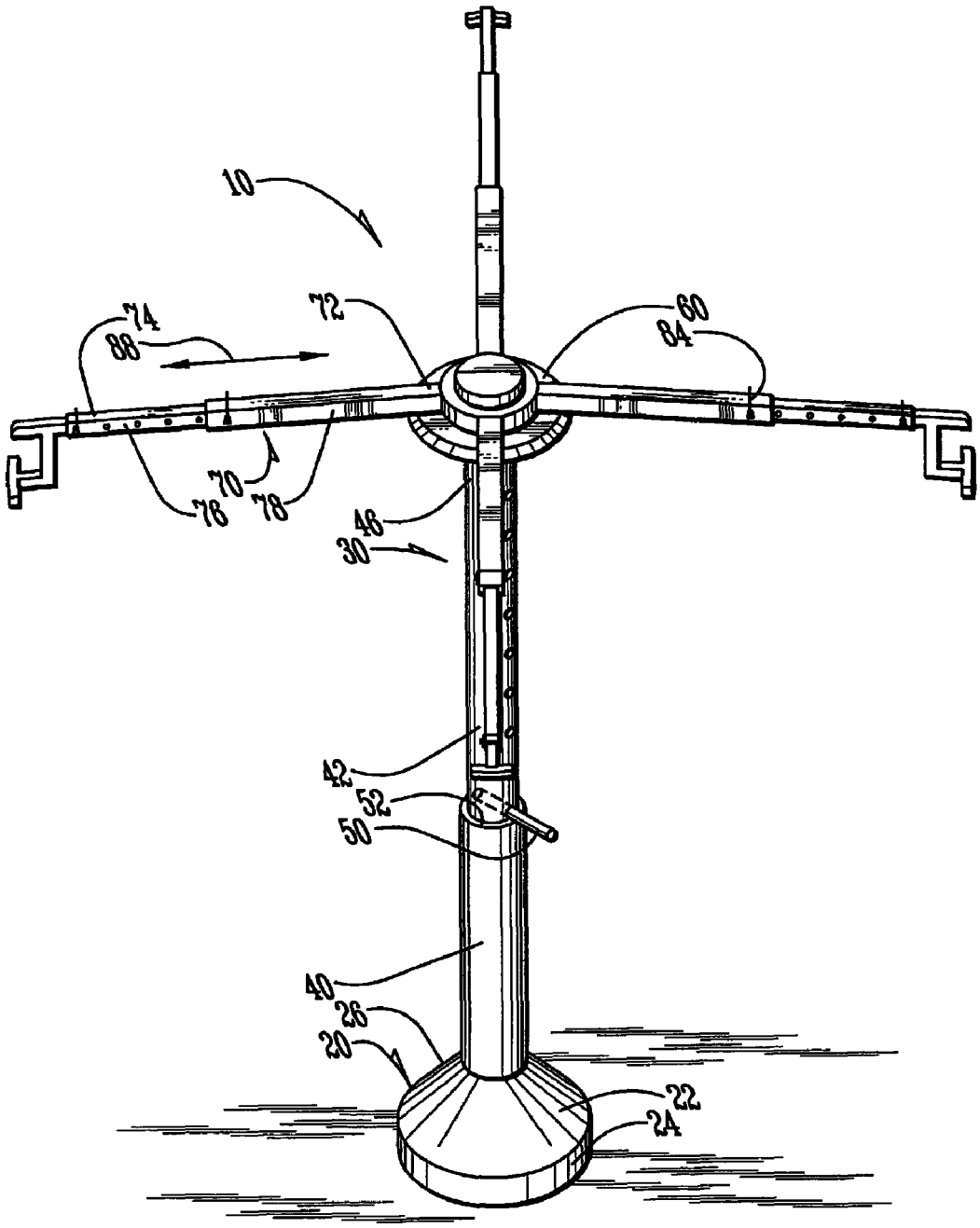
FIG. 1 is a perspective view of an adjustable pool cover support embodying the principles of the present invention.

Referring to the figures, it can be understood that the present invention is embodied in a swimming pool cover support unit 10 which supports a swimming pool cover above the surface of water in a swimming pool in a manner which causes debris or rain or the like to run off the cover whereby the cover does not collect such unwanted material. As will be understood from the teaching of this disclosure, the slidable and adjustable connection between the various elements of the support unit permit it to be adjusted to accommodate pools of various shapes and to be easily dismantled for storage.

The swimming pool cover support unit comprises a base portion 20 which is positioned to float in the water of a swimming pool when in use. The base portion includes a base element 22 having a first section 24 containing heavier-than water ballast, such as sand or the like, and a second section 26 containing lighter-than water material, such as Styrofoam or the like. The heavier-than-water ballast and the lighter-than-water material are balanced with each other so the pool cover support floats in the desired orientation and position.

A cover support 30 includes an adjustable support stanchion adjustably mounted on the base portion to extend vertically upward from the base and which includes two portions 40 and 42 which are telescopingly connected together so the height of the stanchion as measured between the base and a top 46 of the stanchion can be adjusted. A pin element 50 connects the two portions of the stanchion together by extending through holes defined in portion 42 of the stanchion and resting on top rim 52 of portion 40 of the stanchion. A plate element 60 is mounted on the stanchion.

Figure 3:
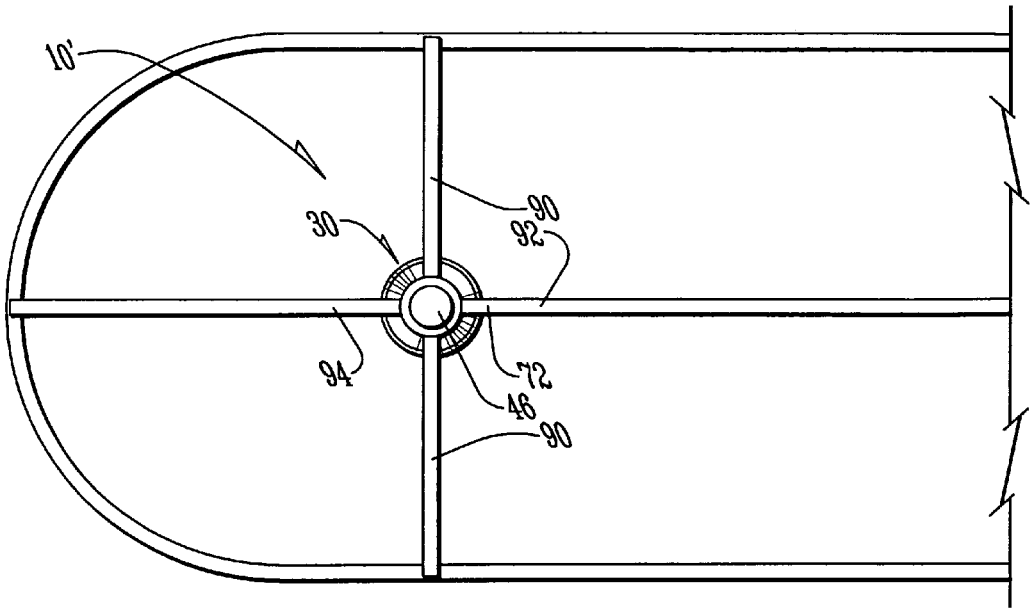
FIG. 3 is a top plan view of an oval shaped pool cover support.

A plurality of adjustable spokes, such as spoke 70, are mounted on the support stanchion. Each spoke is connected at a proximal end 72 thereof to plate element 60 on top of support stanchion and has a distal end 74 spaced apart from the proximal end. Each spoke includes two sections, such as sections 76 and 78 of spoke 70, which are movably connected together by a pin 84 extending through aligned holes defined in each section. Each spoke has a length dimension, such as length dimension 88 of spoke 70, which is measured between the proximal end and the distal end thereof. The spokes are adjustable so that the length dimension of one spoke can differ from the length dimension of an adjacent spoke whereby a pool of non-uniform cross section can be accommodated. This situation is shown in FIG. 3 where the pool has a non-circular shape, such as an oval, and spokes 90 of supporting portion 30 differ in length from adjacent spokes 92 and 94 which differ in length from each other to accommodate the non-circular shape.

A U-shaped distal end unit 100 is located on the distal end of each spoke. Each unit 100 has a first leg 110 telescopingly attached to a distal end of one of the sections of each spoke, a second leg 112 which is spaced apart from the first leg of the distal end unit in a direction toward the base portion when the distal end unit is in use to define a gap 114 between the first and second legs of the distal end unit, and a bight section 116 which connects the two legs of the distal end unit together. A rim 120 of the pool is accommodated in gap 114. The U-shaped distal end units are adjustably mounted on the distal ends of the spokes to further accommodate various shapes for the pool.

Figure 2:
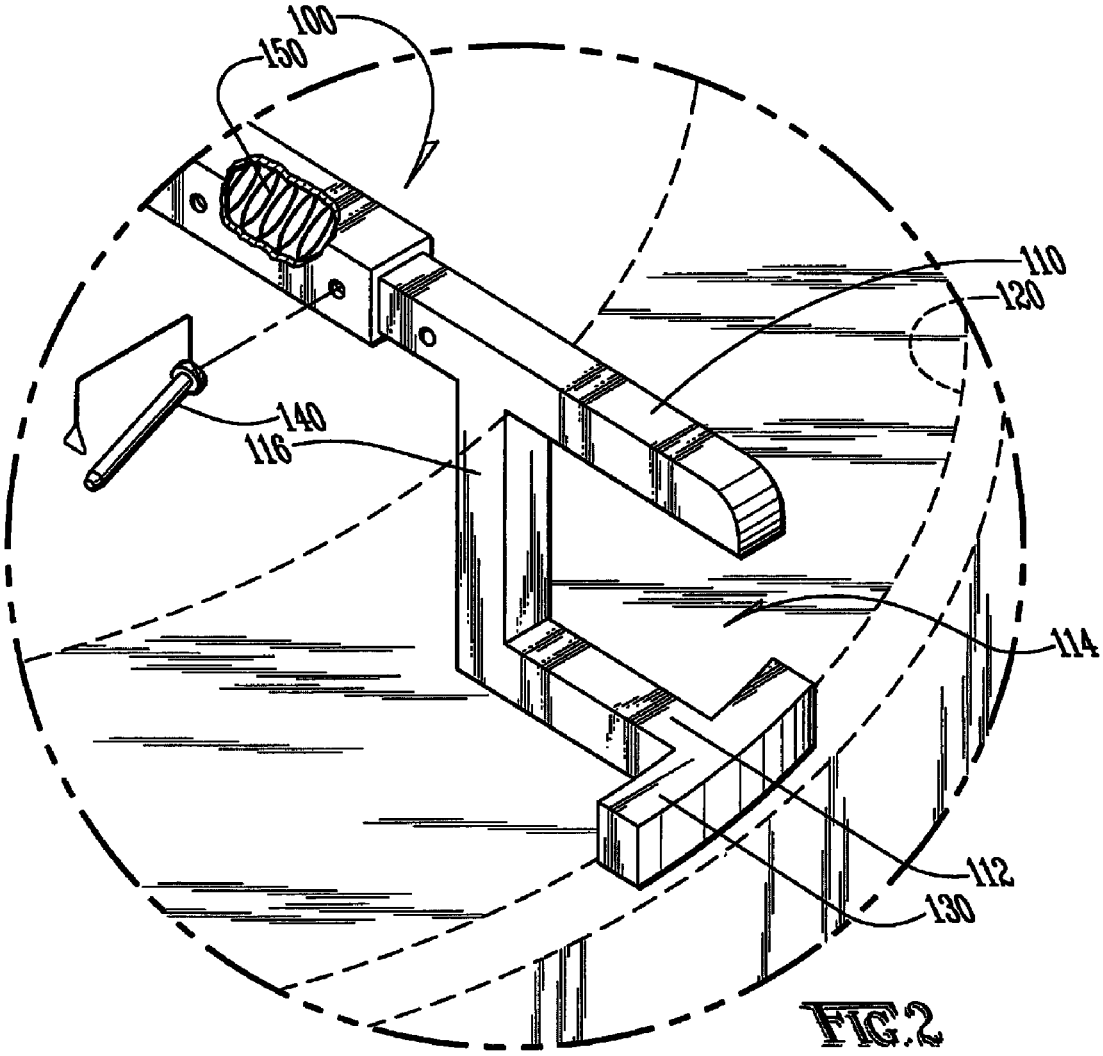
FIG. 2 is a detailed view of an end unit that is associated with each of the spokes and which is attached to the rim of the pool.

A foot element 130 is attached to the second leg of each distal end unit and extends transversely of that second leg. As shown in FIG. 2, the foot element is positioned beneath a rim of the pool and supports the distal end unit on the pool. The distal end unit is attached to the distal end of the spoke by means of a pin clip unit 140 which extends through aligned holes defined in the spoke and in the first leg of the distal end unit. A spring element 150 is interposed between the first leg of the distal end unit and the spoke.

The top of the support stanchion is located above the pool water and the second leg of the distal end unit is located beneath the rim of the pool when in use so the spokes slope downwardly from the proximal ends to the distal ends thereof so water and the like will run off of a pool cover supported thereon.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A swimming pool cover support unit comprising:

a base portion which is positioned in the water of a swimming pool when in use; and a cover supporting portion which includes an adjustable support stanchion adjustably mounted on the base portion to extend vertically upward from the base and which includes two portions which are telescopingly connected together so the height of the stanchion as measured between the base and a top of the stanchion can be adjusted;

a plurality of adjustable spokes, each spoke being connected at a proximal end thereof to the top of support stanchion and having a distal end spaced apart from the proximal end, each spoke including two sections which are movably connected together, each spoke including a length dimension which is measured between the proximal end and the distal end thereof, the spokes being adjustable so that the length dimension of one spoke can differ from the length dimension of an adjacent spoke, and a U-shaped distal end unit which has a first leg telescopingly received in a distal end of one of the sections of each spoke, a second leg which is spaced apart from the first leg of the distal end unit in a direction toward the base portion when the distal end unit is in use to define a gap between the first and second legs of the distal end unit, a rim of the pool being accommodated in the gap, a transverse foot element attached to a distal end of the second leg for contacting a pool wall and a bight section connecting the first and second legs of the distal end unit together.

2. The swimming pool cover support defined in claim 1 wherein the spokes and the U-shaped distal end units are adjustable so that the support is adapted to assume either a circular circumferential configuration or a non-circular circumferential configuration.

3. The swimming pool cover support unit defined in claim 2 wherein the base portion includes a base element having a first section containing heavier-than water ballast and a second section containing lighter-than water material, the amount of heavier-than-water ballast being balanced against the amount of lighter-than-water material so the pool cover support floats in a desired orientation.

4. The swimming pool cover support unit defined in claim 3 wherein the heavier-than water ballast is sand.

5. The swimming pool cover support unit defined in claim 3 wherein the lighter-than water material is Styrofoam.

6. The swimming pool cover support unit defined in claim 1 wherein the top of the support stanchion is located above the pool water and the second leg of the distal end unit is located beneath the rim of the pool when in use so the spokes slope downwardly from the proximal ends to the distal ends thereof.

7. The swimming pool cover support unit defined in claim 1 further including a plate element mounted on the stanchion.

8. The swimming pool cover support unit defined in claim 7 in which the proximal ends of the spokes are attached to the plate element.

9. The swimming pool cover support unit defined in claim 1 further including a spring interposed between a proximal end of the first leg of each distal end unit and the spoke with which it is associated.

10. The swimming pool cover support unit defined in claim 9 further including a pin clip which holds the distal end unit to the spoke with which it is associated.

11. The swimming pool cover support defined in claim 1 wherein a pin element connects the two portions of the stanchion together.

12. The swimming pool cover support defined in claim 1 wherein a pin clip connects the two sections of each spoke together.

* * * * *